United States Patent [19]

Slade et al.

[11] 4,077,026

[45] Feb. 28, 1978

[54] INTEGRAL MOTOR CONTROLLER

[75] Inventors: Paul G. Slade, Pittsburgh; John A. Wafer, Monroeville, both of Pa.

[73] Assignee: Westinghouse Electric Corporation, Pittsburgh, Pa.

[21] Appl. No.: 771,288

[22] Filed: Feb. 23, 1977

Related U.S. Application Data

[63] Continuation of Ser. No. 587,791, Jun. 16, 1975, abandoned.

[51] Int. Cl.[2] ..... H01H 77/10

[52] U.S. Cl. ..... 335/195; 335/16; 335/174

[58] Field of Search ..... 335/195, 147, 16, 170, 335/174, 14, 15, 69

[56] References Cited

U.S. PATENT DOCUMENTS

| | | | |
|---|---|---|---|
| 3,651,436 | 3/1972 | Cooper et al. | 335/13 |
| 3,663,903 | 5/1972 | Kussy et al. | 335/16 |
| 3,824,508 | 7/1974 | Terracol | 335/16 |
| 3,987,382 | 10/1976 | Cataldo et al. | 335/6 |

*Primary Examiner*—Harold Broome
*Attorney, Agent, or Firm*—Robert E. Converse, Jr.

[57] ABSTRACT

A motor controller having a single set of contacts and two contact operating systems is provided for operation and protection of a motor and the associated circuitry over a complete range of possible currents. For a normal motor starter operation and for fault current up to a predetermined value, an electromagnetic actuator is used to open the contacts a relatively small distance such as ¼ inch. For higher fault currents a magnetic drive or linear slot motor opens the contacts to a greater spacing such as 1 inch. The slot motor opens the contacts very rapidly giving rise to good current limiting. The disclosed integral motor starter utilizes a bridging contact arm on which are mounted a pair of movable contacts which are aligned to engage a pair of stationary contacts when the disclosed motor starter is closed, completing an electric circuit to the controlled motor.

19 Claims, 6 Drawing Figures

INTEGRAL MOTOR CONTROLLER

This is a continuation of application Ser. No. 587,791 filed June 16, 1975, and now abandoned.

CROSS REFERENCE TO RELATED APPLICATIONS

The invention disclosed in the instant application is related to the following:

1. U.S. Pat. application Ser. application Ser. No. 613,840;
2. U.S. Pat. No. 437,586; and,
3. U.S. Pat. application Ser. No. 533,413.

BACKGROUND OF THE INVENTION

1. Field of the Invention

This invention is related to combination motor starters and more particularly to an integral motor controller wherein a single set of contacts controlled by two operators are used for operation and protection of the motor and the associated circuitry.

2. Description of the Prior Art

Prior art combination motor starters as exemplified by U.S. Pat. No. 3,638,157 issued to Z. J. Kruzic are provided with separate units which provided for motor starting and stopping, current interruption, and current limiting. It is old in the art to provide a plurality of motor control and circuit protection devices connected in series in a common enclosure for complete motor and circuitry protection. It is old in the art to provide a fuse switch motor starter combination comprising a contactor with series connected overload relays to automatically open the contactor during lower overload current caused by motor overload, current limiting fuses for interrupting high level fault current, and a manual operable switch for permitting manual opening and closing of the motor circuit. It is also old to provide a fuse-breaker combination motor starter comprising a contactor with overload relays for opening the motor circuit upon the occurrence of lower overload currents, a manually operable circuit breaker automatically operable to interrupt the motor circuit upon the occurrence of the low level to high level fault current, and current limiting fuses that operate upon the occurrence of a high level short circuit currents. Prior art motor starters normally comprise a load break device which usually has silver cadmium oxide contacts or the like for low contact resistance. A solenoid mechanism is used to open and close the contacts. Contacts are spring biased toward the open position and are automatically opened if system voltage is lost. Low to high level fault current protection is provided by a series connected molded case circuit breaker. The molded case circuit breaker can be a single break deion circuit breaker with an adjustable magnetic trip. For long life and durability, silver tungsten contacts are often used in the circuit breaker. The adjustable magnetic trip can be set to operate the breaker from 7 to 13 times overload current. The molded case circuit breaker is capable of numerous operation interrupting high overload current. For example, the breaker used on one starter having a 100 ampere rating can interrupt currents up to 15,000 amperes up to three times. Current limitation is provided by current limiting fuses connected in series with the contactor and molded case circuit breaker for protection against possible fault currents up to 100,000 amperes rms. In addition a thermal overload relay which can be adjusted to open the motor stater at currents below the molded case circuit breaker with an appropriate delay are provided. It is also common to provide a series connected disconnect switch.

In the prior art it is necessary to use a plurality of circuit protection and motor control devices to provide for complete protection and operation of the motor and associated circuit over the entire current range.

SUMMARY OF THE INVENTION

An integral motor controller is disclosed which provides for control and protection of the motor and its associated circuit over a complete current range. A device having a single movable contact mechanism is operable by a first operator for normal motor operation and circuit protection up to a predetermined overload current value and operable by a second magnetic driving operator for circuit protection above the predetermined overload current value. The first operator moves the movable contact mechanism to a position of relatively small separation from the stationary contact and the second operator, when the predetermined current value is exceeded, moves the movable contact mechanism to a relatively large separation from the stationary contacts. The disclosed integral motor controller is similar to the motor controller disclosed in copending application Ser. No. 613,840, which discloses a motor starter integrating the functions of motor starting, circuit interruption, and current limiting into a single device with one set of bridging contacts. In copending application Ser. No. 613,840, a linear slot motor is used to provide current limiting action, a flux transfer device is used to provide the circuit breaker action, and an electromagnetic actuator is used to provide for motor starter action. The same contact arm is moved in each case but the travel of the contact arm, its opening speed, and its acceleration are varied in the device disclosed in copending application Ser. No. 613,840. In the present application the flux transfer device is eliminated by extending the range of the operation of the electromagnetic actuator and the linear slot motor magnetic drive device. This can be accomplished by using a new control and trip circuit. The resulting integral motor controller is less complex and less expensive than the controller disclosed in copending application Ser. No. 613,840. However, an integral motor starter using three operators as disclosed therein, may be desirable for some current ratings. It may also be necessary in other applications especially where the separation of tripping adjustments is required.

The integral motor controller disclosed in the present application utilizes a movable contact arm having a movable contact attached thereto and being constructed for moving the movable contact into and out of engagement with a stationary contact. An electromagnetic actuator is associated with the movable contact arm for moving the movable contact arm to the open or closed position to control motor operation and provide circuit protection in some instances. The magnetic driving means is coupled to the movable contact arm to move the movable contact arm to open position under high current fault conditions.

The electromagnetic actuator's armature moves the movable contact arm to a position wherein the contacts are separated by a small separation and the magnetic driving means can move the movable contact to an open position wherein the contacts are separated by a greater separation. The operating range of the solenoid operator and the magnetic driving means overlap slightly to provide for protection of the motor control circuit over a wide continuous current range. A latch is provided for latching the contact arm in the closed position. The latch can be mechanical or magnetic. A biasing spring is provided between the contact arm and the magnetic latch for biasing the movable contact arm to the closed position. The electromagnetic actuator or solenoid is provided with a spring which biases the contact arm to the open position. With the solenoid deenergized, the solenoid spring is strong enough to move the movable contact arm to the open position. This is done, however, without tripping the magnetic latch. When the motor starter is opened by the magnetic driving device the magnetic latch is tripped and the contact arm is moved a relatively greater distance than that provided by operation of the electromagnetic actuator. Before the integral motor controller can be closed again the magnetic latch must be reset. This assures that the magnetic driving device for providing protection against high overload currents is always ready for operation before the solenoid can cause the integral motor starter to close.

It is an object of this invention to teach an integral motor starter having an electromagnetic actuator for providing for operation and protection up to predetermined overcurrent level and a magnetic driving device for providing for current limiting and circuit protection for all currents above the predetermined overload level.

It is an object of this invention to teach an integral motor starting requiring only two operators connected to a single movable contact arm for providing for complete protection and operation of a motor and the associated power circuit.

It is still a further object of this invention to teach an integral motor starter having a first operator which opens a movable contact of the motor starter a small separation for low overload current and a second operator which opens the contacts by a large separation for larger overload current.

BRIEF DESCRIPTION OF THE DRAWINGS

For a better understanding of the invention, reference may be had to the preferred embodiment exemplary of the invention shown in the accompanying drawings, in which.

DESCRIPTION OF THE PREFERRED EMBODIMENT

Figure 1:
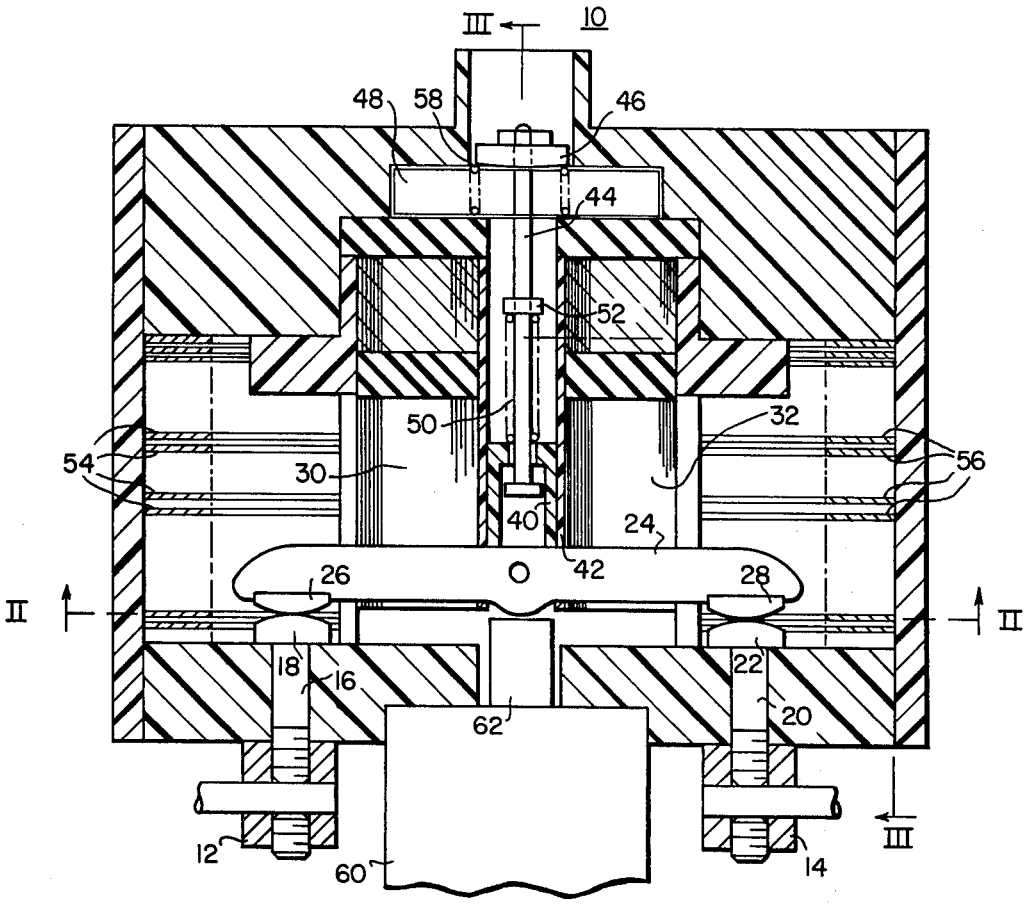
FIG. 1 is a side sectional view of an integral motor starter utilizing the teachings of the present invention.
Figure 2:
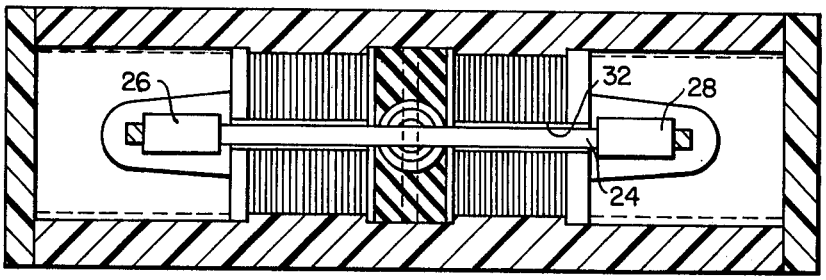
FIG. 2 is a top view of the starter shown in FIG. 1.
Figure 3:
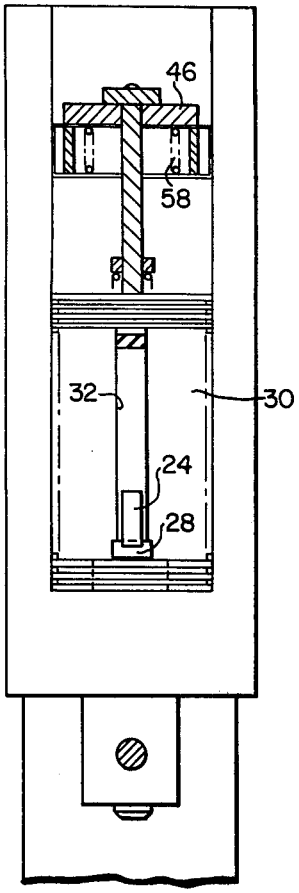
FIG. 3 is an end view of the starter shown in FIG. 1.

Referring now to FIGS. 1 through 3 there is shown an integral motor starter utilizing the teaching of the present invention. Integral motor starter 10 is shown in FIG. 1 in the closed position. Although starter 10 is shown as a single pole device it is to be understood that it can be adapted for any number of poles. Terminals 12 and 14 are provided for connecting integral motor starter 10 in series with the motor and circuit to be protected. A fixed conductor 16 extends from terminal 12 and has a fixed contact 18 attached at one end thereof. A fixed conductor 20 extends from terminal 14 and supports fixed contact 22 at its end. A movable bridging contact arm 24 is disposed within integral motor starter 10. Movable contacts 26 and 28 are mounted spaced apart upon bridging contact arm 24. Bridging contact arm 24 is movable from a closed position to a first open position providing small contact separation or a second contact position providing greater contact separation. Movable contacts 26 and 28 are aligned with fixed contacts 18 and 22.

With integral motor starter 10 in a closed position as shown in FIG. 1 a continuous current path exists from terminals 12 through conductor 16 through contacts 18 and 26 through bridging arm 24 through contacts 28 and 22 through conductor 20 to terminal 14. A laminated rectangular magnetic drive 30 having a slot 32 formed therein is placed around contact arm 24. Contact arm 24 is disposed in proximity to the open end of slot 32. The slot is formed so that contact arm 24 can move approximately 1 inch into the slot. The contact arm 24 is pinned to a tubular connecting member, or guide 40. Guide 40 rides in a nylon bearing sleeve 42. Sleeve 42 is sandwiched between the two laminated halves of magnetic drive yoke 30. A shaft 44, with an enlarged end disposed within tubular guide 40, is supported for movement along its longitudinal axis. A keeper 46 is secured to the other end of shaft 44. A permanent magnet latch 48 is provided for securely holding keeper 46 in place. Permanent magnet latch 48 holds keeper 46 in place with a predetermined force. With integral starter 10 in the closed position, contact closing force is supplied by compression spring 50. Contact pressure spring 50 is disposed between a stop 52 on shaft 44 and an annular surface on tubular connecting member 40.

A set of deion plates 54 and 56 are placed in proximity to each set of contacts 18–26 and 22–28. Shaft 44 disposed in tubular connecting member 40 provides for a lost motion connection allowing contact arm 24 to move approximately ¼ inch without unlatching keeper 46.

Figure 4:
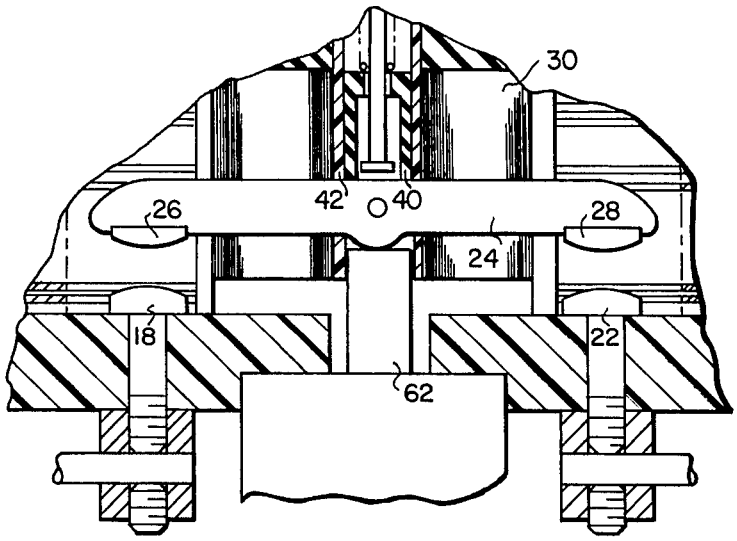
FIG. 4 shows the starter with the contacts in the small separation open position.
Figure 5:
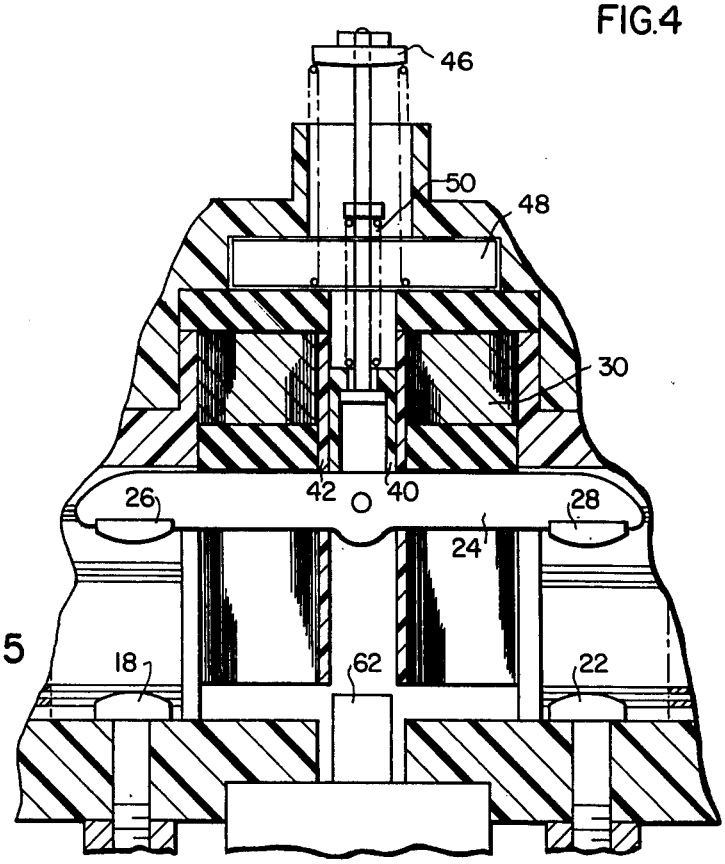
FIG. 5 shows the starter with the contacts in the large separation open position; and, FIG. 6 is a schematic of the control circuit for controlling the electromagnetic actuator of the integral motor controller.

A solenoid or electromagnetic actuator 60 is provided for motor starting and stopping and low current interruption of integral motor starter 10. A shaft 62 projects from one end of solenoid 60 and is movable between a retracted position as shown in FIG. 1 and an extended position in contact with and moving bridging arm 24 as shown in FIG. 4. Shaft 62 is spring biased to its extended position. Shaft 62 retracts when solenoid 60 is energized. Thus if power is lost to solenoid 60, integral motor starter 10 will be opened. Shaft 62 is spring biased to the extended position by a spring having a stronger force than spring 50. Thus when shaft 62 moves to the extended position spring 50 is further compressed. When shaft 62 is in the extended position, movable contacts 26 and 28 are spaced from the stationary contacts 18 and 22 respectively by approximately ¼ inch. For a 100 amp device solenoid 60 moves contact arm 24 by ¼ inch for motor starting and stopping and for interrupting fault current up to approximately 1200 amps.

For fault currents greater than 1200 rms amperes the magnetic drive yoke 30 draws contact arm 26 into the slot 32 approximately 1 inch, unlatching keeper 46. A light spring 58 holds contact arm 24 in the open position when keeper 46 is tripped. Keeper 46 must be reset before solenoid 60 controls operation of starter 10. The operating range of the solenoid 60 and the magnetic driving yoke 30 have been made to overlap, thereby eliminating the need for a flux transfer device as taught in copending application Ser. No. 613,840. Magnetic drive yoke 30 requires no triggering and automatically moves contact arm 24 when current flow through contact arm 24 exceeds a predetermined value. The initial level of operation of magnetic drive yoke 30 depends primarily on the slot width and the cross section of conducting arm 24. Solenoid 60 is tripped not only by motor overload, as is the case with prior art designs with normal overloads, but also it is tripped instantaneously when the current flow is greater than six times rated current.

Figure 6:
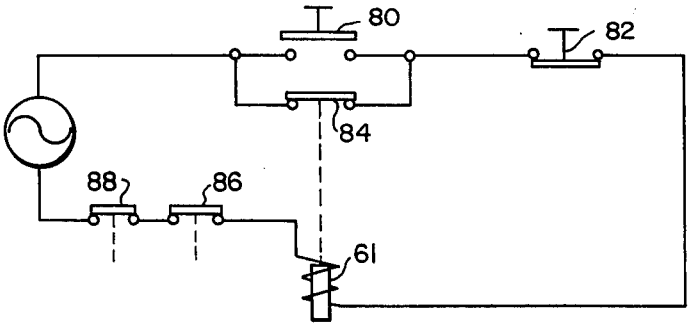

The trip circuit for controlling starter 10 is shown in FIG. 6. The motor overload range can be covered by a thermal overload relay and the instantaneous operation at higher currents can be controlled by an adjustable magnetic trip similar to those used in prior art molded case circuit breakers. Both of the sensing functions can be combined if desired into a solid state time delay circuit with automatic instantaneous trip above six times rated current. This solid state circuit could use current transformer to sense the magnitude of the fault condition in the motor circuit. A normally open pushbutton 80 is used for activating the solenoid coil 61 of solenoid 60. A normally closed stop button 82 is connected in series with solenoid coil 61 for deenergizing solenoid coil 61 when desired. A set of normally open contacts 84 are disposed in parallel with start pushbutton 80. When start pushbutton 80 is depressed contacts 84 which are controlled by solenoid coil 61 are closed sealing in solenoid coil 61. Normally closed contacts 86 can be operated by thermal overload relays with appropriate delays from approximately 110 to 600% rated load current. Normally closed contact 88 can be opened by a magnetic trip similar to that used in molded case circuit breakers above six times rated current. Contacts 86 and 88 can be combined into a single switch or triac control by solid state overload and instantaneous tripping circuit.

It can thus be seen that starter 10 is provided with only two operators 30 and 60 for controlling positioning of bridging contact arm 24. These two operators 30 and 60 provide for complete control of a motor and associated power circuitry over the entire current range.

For a NEMA size 1 starter constructed in accordance with the teaching of the present invention, an opening operation of solenoid 60 could be used to interrupt current up to 1200 amperes when the contact arm 24 is driven ¼ inch. Above the 1200 amp level drive yoke 30 takes over and moves bridging contact arm 24 to a separation of approximately 1 inch. There is no discontinuity in operation of the device since the current ranges controlled by the solenoid 60 and the magnetic yoke 30 overlap. Although the teaching of the present invention has been described for use with a single pole device, it is understood that it could easily be used for multi-poles.

The disclosed integral motor controller provides for smaller size and less complex operation than that provided by prior art devices. The disclosed integral motor starter also has some advantages over the starter disclosed in copending application Ser. No. 613,840, such as elimination of the flux transfer device, elimination of the DC supply requirement, replacement of a flux transfer magnetic circuit requiring a holding force of 30 pounds with a magnetic latch having a holding force of only 10 pounds, and simplification of the reset mechanism because of the smaller load forces involved.

We claim:

1. An integral motor controller comprising:

a housing;

a movable bridging contact arm;

means mounted within said housing for supporting said movable bridging contact arm in a manner so as to permit rectilinear movement thereof;

a pair of movable contacts spaced apart on said movable bridging contact arm;

a pair of stationary contacts spaced apart and supported by said housing in alignment with said pair of movable contacts;

electromagnetic actuator means associated with said movable contact arm to move said movable contact arm from a closed position wherein said pair of stationary contacts engage said pair of movable contacts, to a first open position wherein said pair of stationary contacts are spaced apart from said pair of movable contacts, and from said first open position to said closed position, said electromagnetic actuator being adapted for electrical operation when current flow through the integral motor controller is in the normal range or is in a lower overload range having a predetermined upper current limit; and, magnetic driving means supported by said housing and coupled to said movable contact arm for moving said movable contact arm from the closed position to a second open position when current flow through the integral motor controller lies in an upper overload range overlapping the predetermined upper current limit of the lower overload range.

2. An integral motor controller as claimed in claim 1 wherein:

said electromagnetic actuator means can move said movable contact arm to said first position wherein said pair of movable contacts are spaced a first distance from said stationary contacts; and said magnetic driving means can move said movable contact arm to said second open position where said pair of movable contacts are spaced a distance from said pair of stationary contacts greater than said first distance.

3. An integral motor controller as claimed in claim 1 wherein said magnetic driving means is operable upon current flow in said upper range to move said movable contact arm to said second open position with speed sufficient to obtain current limiting, whereby peak let-through current is held to a value less than the maximum available fault current.

4. An integral motor controller as claimed in claim 3 wherein said magnetic driving means comprises:

a member formed of magnetizable material having a slot with a magnetically open end formed therein; and said movable bridging contact arm is disposed in said slot in proximity to the magnetically open slot end.

5. An integral motor controller as claimed in claim 1 comprising:

a keeper;

connecting means connecting said keeper to said movable bridging contact arm; and, spring biasing means biasing said keeper and said movable bridging contact arm apart;

said support means comprising a permanent magnet cooperating with said keeper to maintain said keeper in a fixed position relative to said permanent magnet until said magnetic drive means operates to move said movable contact arm to said second open position;

whereby said movable contact arm movement is limited to the closed position and the first open position so long as current flow through said controller is below said upper overload range.

6. An integral motor controller as claimed in claim 1 comprising sensing means associated with said controller for operating said electromagnetic actuator means to cause said movable contact arm to automatically move from the closed to said first open position upon occurrence of overload currents within said lower range.

7. Apparatus for controlling an electric motor comprising:

separable contact means;

an electromagnetic actuator operably associated with said separable contact means for opening and closing movement thereof in response to electrical control signals generated external to said apparatus while current flow through said seperable contact means is below a predetermined value; and magnetic driving means magnetically coupled to said separable contact means for opening said separable contact means for all current flow above said predetermined value.

8. Apparatus as recited in claim 7 wherein said electromagnetic actuator comprises a movable member operable between two positions, means biasing said movable member to one of said positions, and a solenoid operable upon energization to move said member in opposition to said bias means.

9. Apparatus as recited in claim 8 wherein said separable contact means comprises stationary contact means and movable contact means.

10. Apparatus as recited in claim 8 comprising means actuated by operating personnel for generating electrical control signals to operate said electromagnetic actuator and cause said operable contact means to move from a closed to an open position and from an open to a closed position; and sensing means responsive to current flow through said apparatus for generating electrical control signals to operate said electromagnetic actuator and cause said movable contact means to automatically move out of engagement with said stationary contact means upon overload currents below said predetermined value.

11. Apparatus as recited in claim 10 wherein said magnetic driving means is operable upon current flow above said predetermined value to drive said movable contact means out of engagement with said stationary contact means with speed sufficient to obtain current limiting, whereby the peak let-through current is held to a value less than the maximum available fault current.

12. Apparatus as claimed in claim 9 wherein:

said movable contact means comprises a movable contact arm; and said magnetic driving means comprises a plurality of stacked laminations formed of a magnetizable material and having a slot formed therein within which is disposed a portion of said movable contact arm;

said magnetic driving means being constructed to move said movable contact means to a spaced apart position with respect to said stationary contact means, the spacing thereby produced being greater than the spacing between said movable and stationary contact means caused by said electromagnetic actuator.

13. Apparatus as claimed in claim 12 comprising:

a keeper;

lost motion connecting means linking said keeper to said contact arm; and biasing means biasing said keeper and said contact arm apart;

said apparatus comprising a permanent magnet cooperating with said keeper to maintain said keeper in a fixed position relative to said permanent magnet until said magnetic driving means operates to move said movable contact means;

whereby said movable contact means movement is limited to that caused by said electromagnetic actuator so long as current flow is below said predetermined value.

14. Apparatus as recited in claim 7 wherein said magnetic driving means is operable upon current flow above said predetermined value to drive said movable contact means out of engagement with said stationary contact means with speed sufficient to obtain current limiting, whereby the peak let-through current is held to a value less than the maximum available fault current.

15. Apparatus for controlling an electric motor comprising:

a housing;

a stationary contact supported within said housing;

a movable contact;

a movable contact arm having said movable contact attached thereto and being movable between an open position and a closed position;

operating means for positioning said movable contact arm in an open position or a closed position in response to an electrical signal when current flow is below a predetermined overload value; and magnetic driving means comprising a slotted magnetizable member within which said movable contact arm is disposed for moving said movable contact arm to the open position for all current flow above the predetermined overload value.

16. Apparatus as recited in claim 15 comprising sensing means responsive to current flow through said apparatus for energizing said operating means to automatically move said contact arm to the open position upon occurrence of overload currents below said predetermined value.

17. Apparatus for controlling an electric motor comprising:

a housing;

a stationary contact disposed within said housing;

a movable contact;

a movable contact arm having said movable contact attached thereto and being constructed for movement to a small separation open position, wherein said movable contact is separated from said stationary contact by a relatively small separation, and a large separation open position, wherein said movable contact is separated from said stationary contact by a relatively large separation;

operating means associated with said movable contact arn for moving said movable contact arm from the closed position to the small separation open position and from the small separation open position to the closed position when current flow is below a predetermined value; and magnetic driving means associated with said movable contact arm for moving said movable contact arm to the large separation open position for all current flow above the predetermined value.

18. Apparatus as recited in claim 17 comprising sensing means responsive to current flow through said apparatus for energizing said operating means to automatically move said contact arm to the small separation open position upon occurrence of overload currents below said predetermined value.

19. Apparatus for controlling an electric motor comprising:

a housing;

separable contact means supported within said housing and operable between open and closed positions;

electrically energizable electromagnetic actuator means operably associated with said separable contact means for opening and closing of said separable contact means upon energization by operating personnel situated at a remote location and for automatic opening movement of said separable contact means upon overload currents below a predetermined value; and magnetic driving means magnetically coupled to said separable contacts for rapidly separating said contacts upon overload currents above said predetermined level, said separation occurring with speed sufficient to obtain current limiting whereby peak let-through current is less than the available fault current.

* * * * *